US005686679A

United States Patent [19]

Nakano et al.

[11] Patent Number: 5,686,679

[45] Date of Patent: Nov. 11, 1997

[54] PERCUSSION INSTRUMENT WITH TONE BARS FOR EXACTLY GENERATING TONES ON A SCALE

[75] Inventors: Minoru Nakano; Hiroaki Ohmuro, both of Shizuoka, Japan

[73] Assignee: Yamaha Corporation, Japan

[21] Appl. No.: 588,065

[22] Filed: Jan. 16, 1996

[30] Foreign Application Priority Data

Jan. 20, 1995 [JP] Japan ..... 7-007674

[51] Int. Cl.[6] ..... G10D 13/08

[52] U.S. Cl. ..... 84/402; 84/403

[58] Field of Search ..... 84/402, 403, 404, 84/410, 102

[56] References Cited

U.S. PATENT DOCUMENTS

| | | | |
|---|---|---|---|
| 1,632,751 | 6/1927 | Winterhoff | 84/403 |
| 1,838,502 | 12/1931 | Schluter | 84/403 |
| 2,133,712 | 10/1938 | Musser | 84/403 |
| 2,655,069 | 10/1953 | Marshall | 84/404 |
| 2,703,504 | 3/1955 | Rowe | 84/402 |
| 3,013,461 | 12/1961 | Kunz | 84/402 |
| 5,198,602 | 3/1993 | Roper | 84/403 |

FOREIGN PATENT DOCUMENTS 60-159894 8/1985 Japan .

*Primary Examiner*—Cassandra C. Spyrou
*Assistant Examiner*—Shih-yung Hsieh
*Attorney, Agent, or Firm*—Ostrolenk, Faber, Gerb & Soffen, LLP

[57] ABSTRACT

A plurality of metal bars of a vibraphone are regulated such that the first-order to third-order vibration approximate to the frequency ratio of 1:4:8 by using recesses formed in the central portion of the metal bar and the end portions on both sides of the central portion, and a player can make the metal bars generate tones exactly on a scale so as to harmonize with one another.

17 Claims, 11 Drawing Sheets

PERCUSSION INSTRUMENT WITH TONE BARS FOR EXACTLY GENERATING TONES ON A SCALE

FIELD OF THE INVENTION

This invention relates to a percussion instrument and, more particularly, to a percussion instrument having tone plates for exactly generating tones on a scale.

DESCRIPTION OF THE RELATED ART

A xylophone, a glockenspiel, a vibraphone and a marimba are classified into the percussion instrument of definite pitch, and a plurality of slabs or sound bars are arranged in the percussion instrument. The slabs or the sound bars are formed of wood or metal, and are usually supported by felt members or strings over a frame. While a player is selectively striking the sound bars with mallets, the sound bars vibrate, and generate the tones.

The vibrations of a sound bar are broken down into longitudinal vibration components, transverse vibration components and torsional vibration components. The transverse vibration components contain transverse vibrations in the vertical plane and transverse vibrations in the horizontal plane. When the sound bar is designed, the designer mainly takes the transverse vibrations in the vertical plane into account, and tunes the sound bars.

FIG. 1 illustrates the vibrations generated in a sound bar upon an impact with a mallet. Plots f0 stands for the first-order or fundamental vibration, and the second-order and the third-order vibrations are represented by plots f1 and f2, respectively. However, the vibrations higher than the third-order vibration are deleted from FIG. 1. These high-order vibrations affect the timbre of the tone. The first-order vibration to high-order vibrations are hereinbelow referred to as "first-order vibration mode", "the second-order vibration mode", "the third-order vibration mode" and so forth.

A musical instrument has various families, and the sounds generated by the families are largely broken down into a tone and an unpitched sound. The tone is defined as "vibrations consisting of the fundamental frequency and harmonics thereof", and a listener easily discriminates the fundamental pitch of the tone. The unpitched sound does not fall under the definition of the tone.

A string instrument generates the sounds through vibrations of the strings, and the cross section of the string is approximated to zero. For this reason, the high-order harmonics have respective frequencies substantially multiples of the fundamental frequency, and the sounds generated by the string instrument fall under the definition of the tone.

A wind instrument such as a clarinet generates a sound, a harmonic fi of which is given by equation 1.

$$fi=(c/21)\times i$$

where c is the acoustic velocity in the air and i is an integer. The frequencies of the high-order harmonics are integers of the fundamental frequency, and the harmonic distortion affects the timbre of the tone. The second-order harmonic differs from the fundamental frequency by an octave, and the third-order harmonic is spaced from the second-order harmonic by fifth. For this reason, the pitches of the sound is clearly discriminative by a listener, and the wind instrument generates the sounds having vibration pitches in the harmonic series.

On the other hand, the sounds generated by the percussion do not fall under the strict definition of the tone. In detail, the percussion is of definite pitch or indefinite pitch. The xylophone, the glockenspiel, the vibraphone, the marimba and kettledrums (or timpani) are of the percussion of the definite pitch, and other drums, a triangle and a gong are examples of the percussion of the indefinite pitch. A sound generated by the percussion of the indefinite pitch is spread over a wide frequency range. Although a listener feels the sound high or low on the basis of strong frequency components, it is impossible to identify the pitch of the sound. Therefore, the sound generated by the percussion of the indefinite pitch does not fall under the definition of the tone, and is the intermediate zone between the tone and the unpitched sound.

The kettledrum is tuned to a definite pitch by changing the tension exerted on the skin along the rim, and the sound generated by the kettledrum has a vibration pitches close to the harmonic series.

The sound bars of the glockenspiel are equal in cross section, and are only different in length. The length of the sound bar mainly regulates the fundamental vibration, and, accordingly, determines the pitch of the tone. However, the frequency ratios of the second-order to fourth-order vibrations to the fundamental vibration are 2.765, 5.404, 8.933, and the high-order vibrations are not the multiples of the fundamental vibrations. Although the sounds generated by the glockenspiel are closer to the tone than the sounds generated by the percussion of the indefinite pitch, the sounds do not fall under the strict definition of the tone. The other percussion instruments of the definite pitch such as the xylophone and the marimba also do not generate the sound falling under the strict definition of the tone.

In this situation, it is getting stronger and stronger that the music world requests the percussion instruments to generate the tones. Manufacturers of the percussion instruments have improved the percussion instruments. For example, Japanese Patent Publication of Unexamined Application No. 60-159894 discloses sound bars varied in cross section so as to make the frequency ratio of each vibration mode an integer.

FIGS. 2A and 2B illustrate a sound bar 1 incorporated in a marimba or a vibraphone, and the prior art sound bar 1 has side portions 1*a* and 1*b* thicker than a central portion 1*c* therebetween. Holes 1*d* and 1*e* are formed in the side portions 1*a* and 1*b*, respectively, and strings (not shown) pass through the holes 1*d* and 1*e* so as to support the sound bar 1. The prior art sound bar 1 is tuned in such a manner as to have the frequency ratio of the first-order to third-order vibration modes is 1:4:10.

FIGS. 2C and 2D illustrate a sound bar 2 incorporated in a xylophone, and the prior art sound bar 2 has straight side portions 2*a* and 2*b* and a central portion 2*c* waved twice between the side portions 2*a* and 2*b*. Holes 2*d* and 2*e* are formed in the straight side portions 2*a* and 2*b*, and strings (not shown) also pass through the holes 2*d* and 2*e*. The prior art sound bar 2 is tuned in such a manner as to regulate the frequency ratio of the first-order to third-order vibration modes to 1:3:6 or 1:3:7. Although there is a possibility that the frequency of the third-order vibration mode is not tuned, the sound bars 1 and 2 shown in FIGS. 2A/2B and 2C/2D approximate the frequencies to the above ratios. Comparing the sound bar 1 shown in FIGS. 2A and 2B with the sound bar 2 shown in FIGS. 2C and 2D, the sound bar 1 generates the second vibration mode $2^n$ times larger in frequency than the first vibration mode, and achieves a kind of consonant. However, when it is compared with a string instrument and a wind instrument, the e frequency ratio of $2^n$ where n is 0, 1 and 2, and the vibration modes become close to the harmonic series. However, there is yet room for improvement in consonance and musical interval.

SUMMARY OF THE INVENTION

It is therefore an important object of the present invention to provide a percussion which generates sounds consonant like the string instrument and the wind instrument.

In accordance with the present invention, there is provided a percussion instrument comprising: a plurality of sound bars respectively assigned notes of a scale, and generating vibrations when a player beats, the vibrations of each of the plurality of sound bars having at least a first-order vibration for mainly impressing the note assigned to the aforesaid each of the plurality of sound bars, a second-order vibration and a third-order vibration, a frequency ratio of the first-order vibration, the second-order vibration and the third-order vibration being approximately equal to 1:4:8; and a frame structure supporting the plurality of sound bars, and allowing the plurality of sound bars to freely vibrate.

The sound bar may have a central portion formed with a recess and end portions contiguous to the central portion and formed with respective recess so as to regulate the frequency ratio to 1:4:8.

The sound bar may have a central portion formed with a multiple recess and end portions without a recess so as to regulate the frequency ratio to 1:4:8.

BRIEF DESCRIPTION OF THE DRAWINGS

The features and advantages of the percussion instrument according to the present invention will be more clearly understood from the following description taken in conjunction with the accompanying drawings in which.

DESCRIPTION OF THE PREFERRED EMBODIMENTS

First Embodiment

Figure 3:
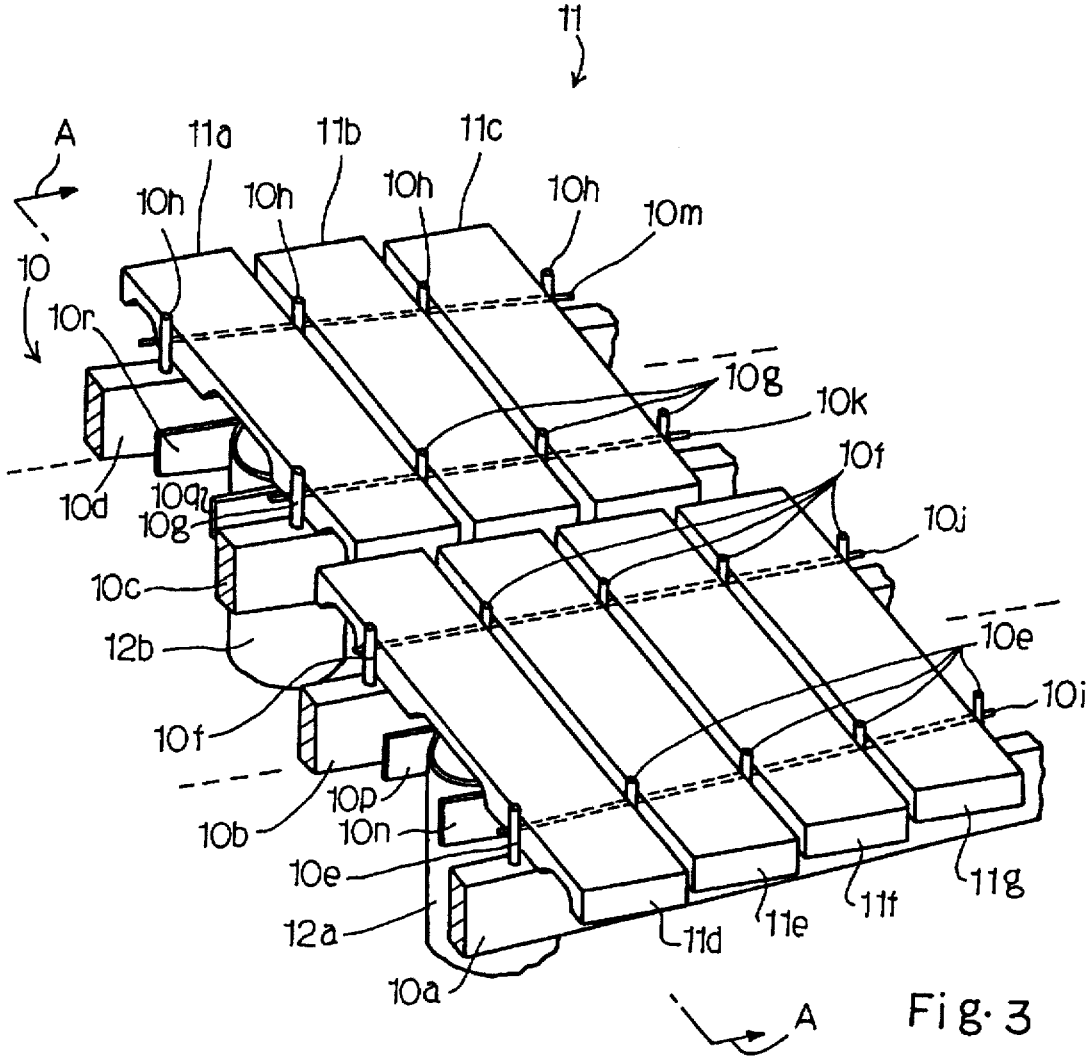
FIG. 3 is a perspective view showing a vibraphone according to the present invention.

Referring to FIG. 3 of the drawings, a vibraphone embodying the present invention largely comprises a frame structure 10, a plurality of metal bars 11 and a plurality of resonators 12*a* and 12*b*. Although the plurality of metal bars 11 are laid out on the pattern of a keyboard incorporated in a standard piano, only seven metal bars 11*a*, 11*b*, 11*c*, 11*d*, 11*e*, 11*f* and 11*g* are mounted on the frame structure 10 in FIG. 3. In this instance, the plurality of metal bars 11 serve as a plurality of sound bars.

The frame structure 10 comprises two pairs of lateral bars 10*a*/10*b* and 10*c*/10*d*, a plurality of pin members 10*e*, 10*f*, 10*g* and 10*h* implanted into the lateral bars 10*a* to 10*d* at intervals, two pairs of braids 10*i*/10*j* and 10*k*/10*m* spread over the lateral bars 10*a* to 10*d* and two pairs of rail members 10*n*/10*p* and 10*q*/10*r* respectively extending inside of the two pairs of lateral bars 10*a* to 10*d*. The braids 10*o* to 10*m* are respectively associated with the four lines of the pin members 10*e* to 10*h*, and pass through the holes formed in the associated pin members 10*e* to 10*h*. The braids 10*i* to 10*m* make knots (not shown) outside of the outermost pin members 10*e* to 10*h*, and the knots do not allow the braids 10*i* to 10*m* to slip out.

The plurality of metal bars 11 cover a compass for three octaves, by way of example, and notes of a scale are respectively assigned to the plurality of metal bars 11. The plurality of metal bars 11 are arranged in two rows over the two pairs of lateral bars 10*a*/10*b* and 10*c*/10*d*, and a player stands in front of the first row including the metal bars 11*d* to 11*g*. The metal bars of the first row generate the natural tones. On the other hand, the metal bars of the second row generate the other tones usually represented by using sharp or flat. The metal bars 11*a* to 11*c* are staggered with respect to the metal bars 11*d* to 11*g* by half pitch, and each of the metal bars 11*a* to 11*c* is located between the adjacent two metal bars 11*d*/11*e*, 11*e*/11*f* or 11*f*/11*g*.

Figure 4A:
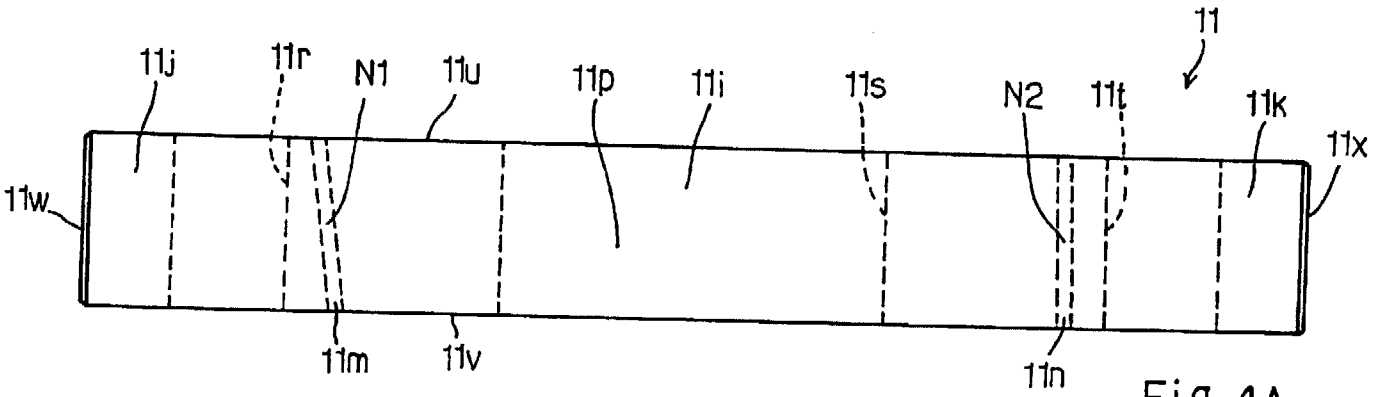
FIG. 4A is a plan view showing a metal bar incorporated in the vibraphone.
Figure 4B:
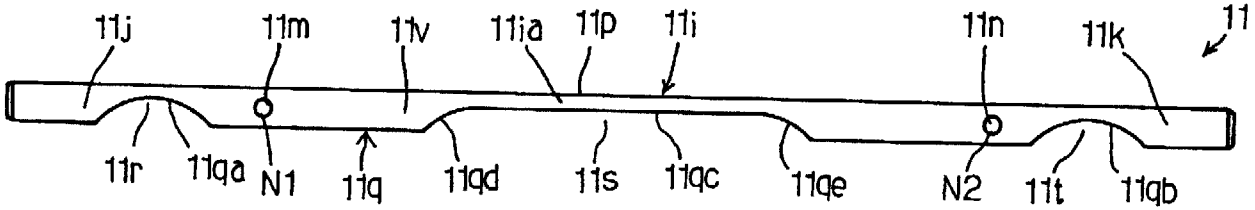
FIG. 4B is a front view showing the metal bar.
Figure 4C:
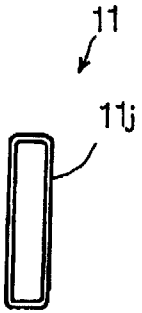
FIG. 4C is a side view showing the metal bar.

FIGS. 4A to 4C illustrate one of the metal bars 11. All of the metal bars 11 are similar in configuration. The metal bars 11 are equal in width to one another, and are different in length depending upon the notes assigned thereto. The metal bar 11 is a generally rectangular parallelepiped configuration, and is divided into a central portion 11*i* and end portions 11*j* and 11*k*. Two holes 11*m* and 11*n* are respectively formed in a boundary between the end portion 11*j* and the central portion 11*i* and a boundary between the end portion 11*k* and the central portion 11*i*.

The braids 10*i* and 10*j* respectively pass through the holes 11*m* and 11*n*, and support the metal bars 11 of the first row over the pair of lateral bars 10*a*/10*b*. On the other hand, the braids 10*k* and 10*m* pass through the holes 11*m* and 11*n*, and the metal bars 11 of the second row are supported through the braids 10*k* and 10*m* by the pin members 10*g*/10*h* over the pair of lateral bars 10*c*/10*d*.

An upper surface 11*p* is flat, and a player beats the upper surface with a mallet (not shown). The lower surface 11*q* is partially curved, and forms recesses 11*r*, 11*s* and 11*t* in the end portion 11*j*, the central portion 11*i* and the other end portion 11*k*, respectively. The remaining lower surface 11*q* is flat between the recesses 11*r* and 11*s* and the recesses 11*s* and 11*t*, and are substantially parallel to the upper surface 11*p*. The lower surface 11*q* defining the recesses draws arcs 11*qa* and 11*qb*, and a flat sub-surface 11*qc* and round sub-surfaces 11*qd* and 11*qe* form the lower surface 11*q* defining the recess 11*s*. The flat sub-surface 11*s* is substantially in parallel to the upper surface 11*p*. The recess 11*s* makes the central portion 11*i* partially thinner than those on both sides thereof, and the part of the central portion 11*i* along the flat sub-surface 11*qc* is hereinbelow called as a flat central sub-portion 11*ia*.

The hole 11*m* is oblique with respect to side surfaces 11*u* and 11*v*, and the other hole 11*n* is normal to the side surfaces 11*u* and 11*v*. Additionally, the reason why one of the holes 11*m* obliquely extends is that the distance between the nodes N1 and N2 is decreased together with the length of the sound bar depending upon the pitch of the sound. End surfaces 11*w* and 11*x* are substantially in parallel to each other, and the peripheries of the end surfaces 11*w* and 11*x* are chamfered.

The direction between the end surfaces is hereinbelow referred to as "longitudinal direction", and "length" represents the distance in the longitudinal direction. On the other hand, "width" is indicative of the distance between the side surfaces 11*u* and 11*v*, and the width is measured in a lateral direction of the metal bar 11.

When a player beats the metal bar 11, vibrations are generated in the metal bar 11, and contains a fundamental or first-order vibration, a second-order vibration and a third-order vibration. The first-order vibration mainly impresses the note assigned to the metal bar 11 beaten by the player, and high-order vibrations, i.e., the second-order vibration, the third-order vibration and so forth affect the timbre of the sound.

The antinode of the first-order vibration takes place in the flat central sub-portion 11*ia*, and the nodes N1 and N2 of the first-order vibration take place in the holes 11*m* and 11*n*. The recesses 11*r* and 11*t* are located outside the nodes N1 and N2.

The frequency ratio of the first-order to the third-order vibrations is regulable by changing the dimensions of the recesses 11*r*, 11*s* and 11*t*. In detail, as described hereinbefore, when the rectangular parallelepiped sound bar is beaten, the frequency ratio of the first-order vibration f0, the second-order vibration f1 and the third-order vibration f2 is 1:2.765:5.404. In order to regulate the frequency ratio to 1:4:8, it is necessary to lower the frequency of the first-order vibration f0 relatively to the frequencies of the second-order and third-order vibrations f1 and f2 and further lower the frequency of the second-order vibration f1 relatively to the third-order vibration f2.

Each of the first-order to third-order vibrations has a node with the minimum amplitude and an antinode with the maximum amplitude. In general when a recess is formed in a sound bar, the recess has an influence on the frequencies of all the vibration modes to some extent. However, the power of the influence is different among the vibration modes. If a recess is located in a place where an antinode of a vibration takes place, the recess widely decreases the frequency of the vibration. On the other hand, if a recess is matched with a node of a vibration, the recess slightly decreases the frequency of the vibration. The recess 11*s* has the strongest influence on the first-order vibration. The second-order vibration is subsequently affected by the recess 11*s*, because the adjacent two antinodes takes place in or around the flat thin sub-portion 11*ia*. However, the recess 11*s* has the least influence on the third-order vibration among the first-order to third-order vibrations.

Figure 5:
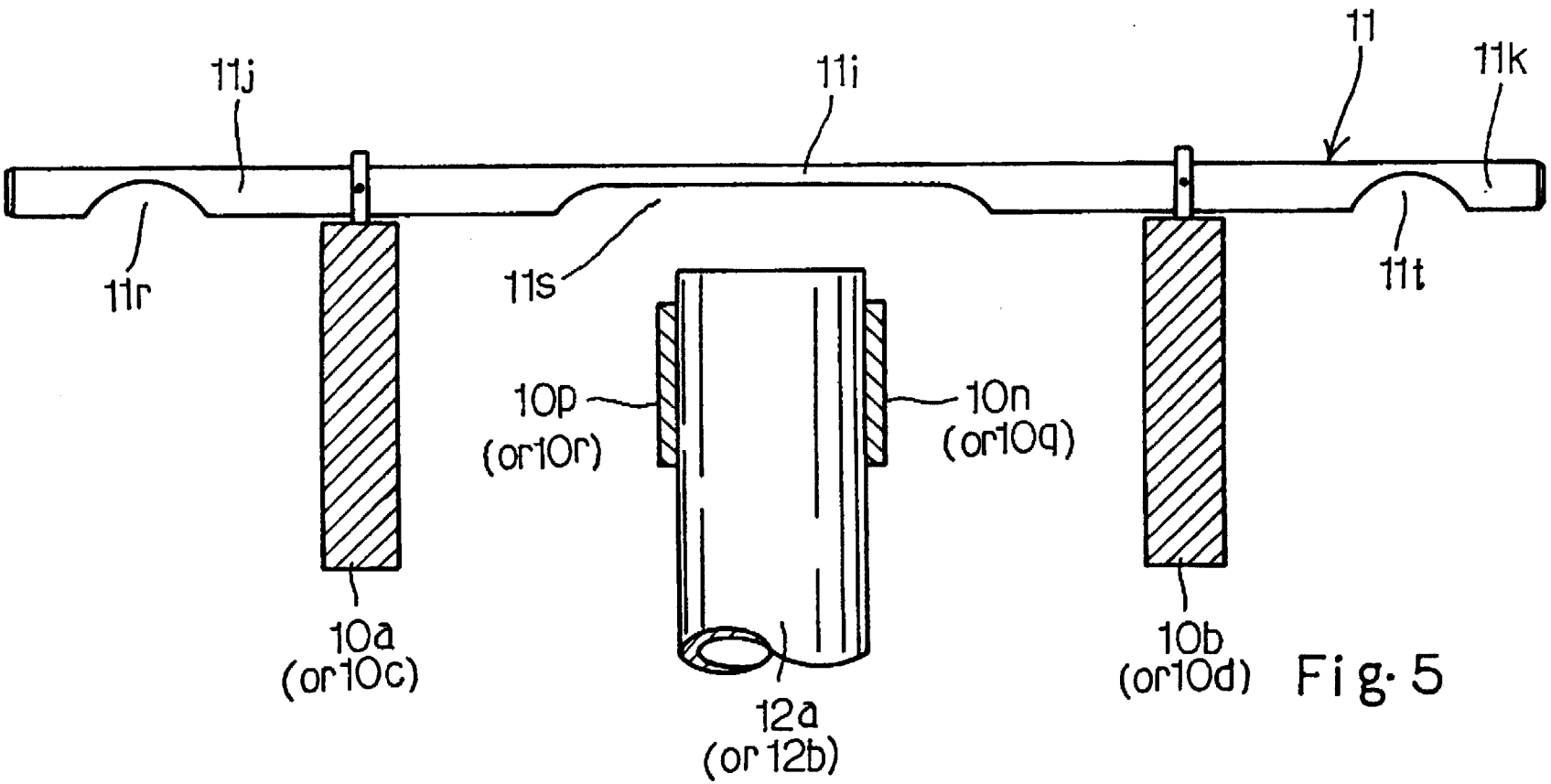
FIG. 5 is a cross sectional view taken along line A—A of FIG. 3 and showing the structure of the vibraphone.

Turning back to FIG. 3 of the drawings, the resonators 12*a* and 12*b* are implemented by metal tubes, and are supported beneath the metal bars 11 by the pairs of rails 10*n*/10*p* and 10*q*/10*r* (see FIG. 5). When the metal bar 11 is beaten, the metal bar 11 vibrates, and the associated resonator 12*a*/12*b* imparts a vibrating sound to the tone.

Figure 1:
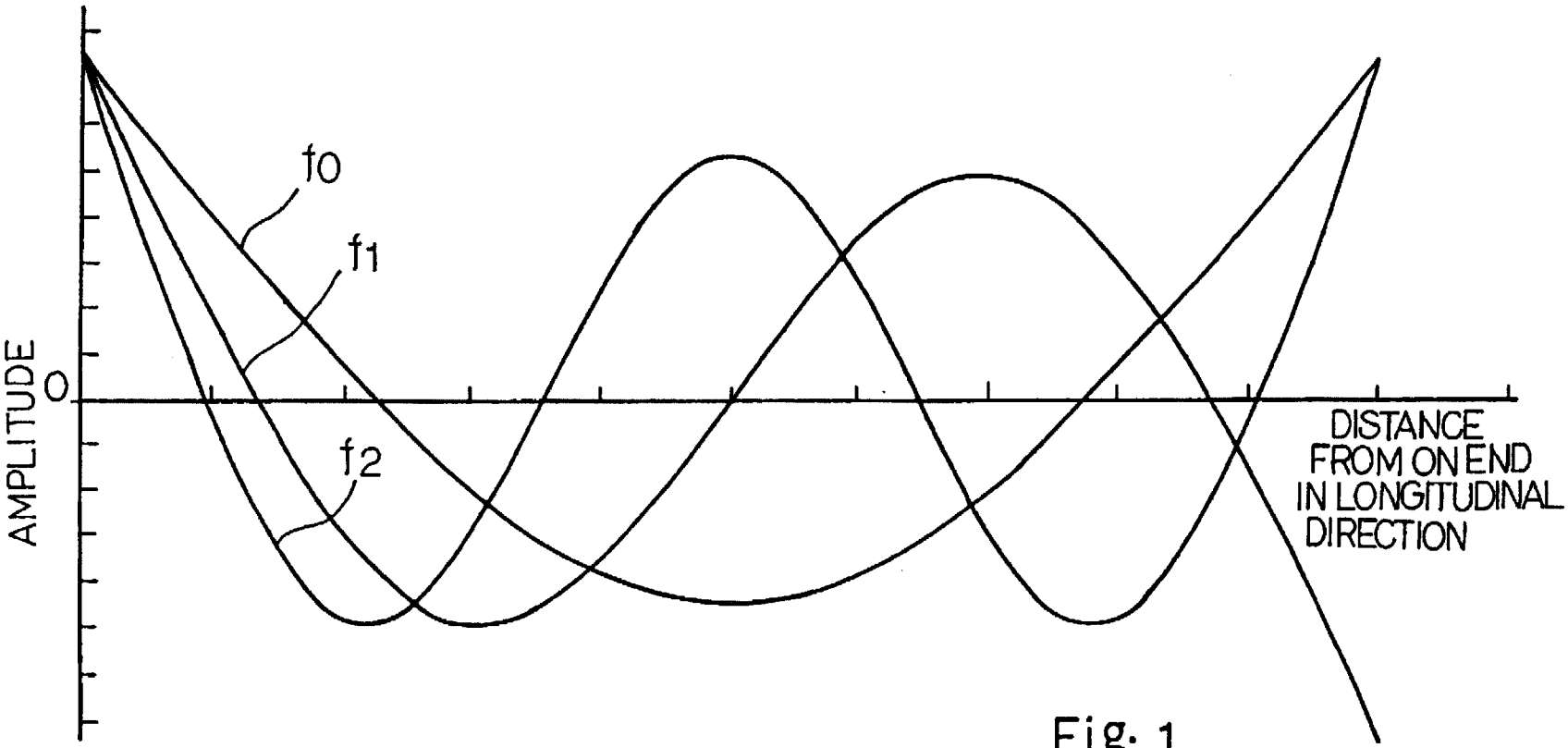
Fig. 1 PRIOR ART
FIG. 1 is a graph showing the first-order to third-order vibrations generated by the prior art sound bar.
Figure 2B:
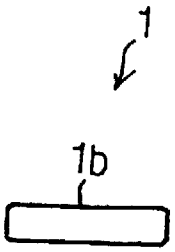
Fig. 2B PRIOR ART
FIG. 2B is a side view showing the prior art sound bar for the marimba or the vibraphone.
Figure 2D:
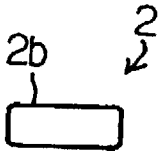
Fig. 2D PRIOR ART
FIG. 2D is a side view showing the prior art sound bar for the xylophone.
Figure 2A:
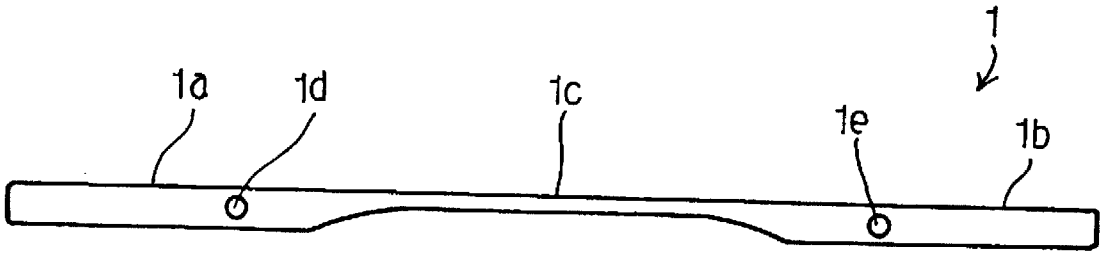
Fig. 2A PRIOR ART
FIG. 2A is a front view showing the prior art sound bar incorporated in the marimba or the vibraphone.
Figure 2C:
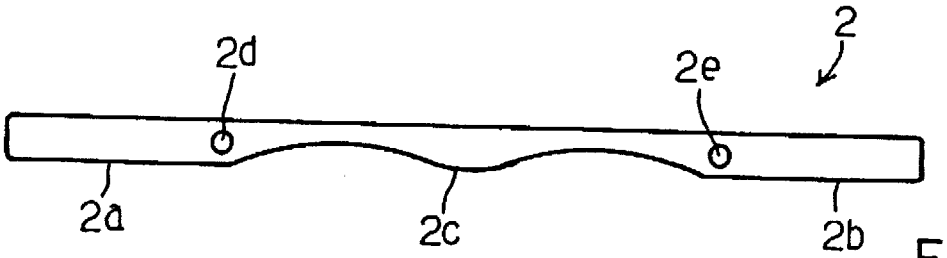
Fig. 2C PRIOR ART
FIG. 2C is a front view showing the prior art sound bar incorporated in the xylophone.

Subsequently, description is made on advantages of the metal bar 11 over the sound bar 1 of the prior art vibraphone shown in FIGS. 2A and 2B.

In this instance, the frequency ratio of the first-order vibration, the second-order vibration and the third-order vibration is regulated to 1:4:8. In other words, the second-order vibration is 2 octaves higher than the first-order vibration, and the third-order vibration is 3 octaves higher than the first-order vibration. If one of the metal bars 11 is tuned to A1, the first-order vibration is 442 Hz, and the second-order vibration and the third-order vibration are corresponding to A3 two octaves higher than A1 and A4 three octaves higher than A1, respectively. The second-order vibration and the third-order vibration emphasizes the note of the first-order vibration, and the vibraphone according to the present invention clearly discriminative tones. Thus, the metal bar 11 generates the first-order vibration to the third-order vibration identical in the pitch name with one another, and the vibrations fall under the strict definition of the tone.

As described hereinbefore, the second-order vibration generated by the prior art sound bar 1 is four times larger in frequency than the first-order vibration, and the third-order vibration is ten times larger in frequency than the first-order vibration. The frequency ratio of the metal bar 11 is smaller than that of the prior art sound bar 1, and, accordingly, the frequency spectrum generated by the metal bar 11 is denser than that of the prior art sound bar 1. In other words, the tone generated by the prior art sound bar 1 is less consonant with related tones. On the other hand, the tone generated by the metal bar 11 is highly consonant with related tones. In general, the consonance takes place through gentle beat due to an interference between the frequency components close to one another. When the prior art sound bars 1 vibrate for generating a chord, there is a large difference between the second-order vibration of the higher tone and the third-order vibration of the lower tone, and the second-order vibration of the higher tone is seldom interfered with the third-order vibration of the lower tone. As a result, the higher tone and the lower tone hardly form the chord. On the other hand, the third-order vibration generated by the metal bar 11 is eight times larger in frequency than the first-order vibration. When related metal bars 11 are beaten for generating a chord, the second-order vibration of the higher tone is close to the third-order vibration of the lower tone, and is liable to be interfered with the third-order vibration of the lower tone. The interference results in gentle beat, and the higher tone and the lower tone form the chord.

Finally, the metal bars 11 form a compass wider than the compass prior art sound bar 1. The standard pitch used in the tuning is A1 at 442 Hz, and the standard frequency analyzer can measure the frequency until C5 at 4205 Hz. If the frequency ratio is 1:4:10, the standard frequency analyzer can regulate until G#1 at 417.2 Hz, because the third-order vibration of the next tone exceeds the upper limit of the standard frequency analyzer. On the other hand, the metal bar 11 has the frequency ratio of 1:4:8, and the standard frequency analyzer can check C2 at 525.6 Hz. Thus, the metal bars 11 provide a wider compass.

Second Embodiment

Figure 6A:
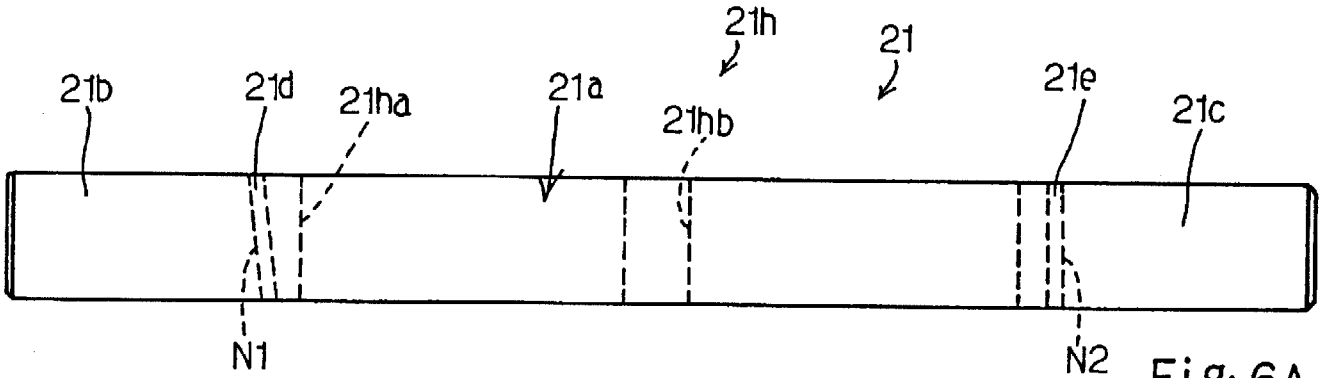
FIG. 6A is a plan view showing a sound bar incorporated in another percussion instrument according to the present invention
Figure 6B:
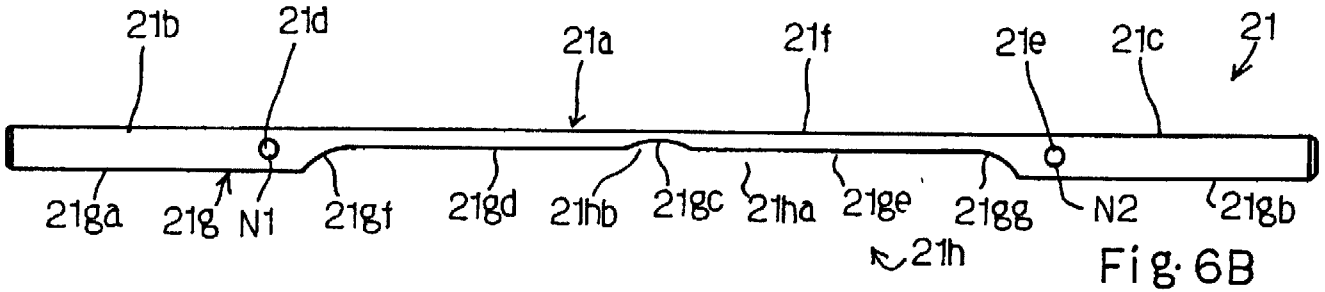
FIG. 6B is a front view showing the sound bar.
Figure 6C:
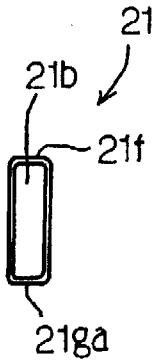
FIG. 6C is a side view showing the sound bar.

FIGS. 6A to 6C of the drawings illustrate a sound bar 21 incorporated in a percussion instrument embodying the present invention. The sound bar 21 is divided to a central portion 21*a* and end portions 21*b* and 21*c*, and holes 21*d* and 21*e* are formed in the boundary between the end portion 21*b* and the central portion 21*a* and between the central portion 21*a* and the end portion 21*c*. Though not shown in FIGS. 6A to 6C, braids pass through the holes 21*d* and 21*e*, and the sound bar 21 floats over a frame structure (not shown).

The sound bar 21 has a flat upper surface 21*f* beaten with a mallet (not shown), and a lower surface 21*g* is partially curved so as to form a multiple recess 21*h* in the central portion 21*a*. However, the end portions 21*b* and 21*c* have respective flat lower sub-surface 21*ga* and 21*gb* substantially in parallel to the upper surface 21*f*, and no recess is formed in the end portions 21*b* and 21*c*.

The lower surface 21*g* defines the multiple recess 21*h* as follows. The lower surface 21*g* is curved to form an arc sub-surface 21*gc* at the mid portion of the sound bar 21, and flat lower sub-surfaces 21*gd* and 21*ge* are contiguous to the arc sub-surface 21*gc* in parallel to the upper surface 21*f*. Round sub-surfaces 21*gf* and 21*gg* extend between the flat lower sub-surface 21*gd* and the flat lower sub-surface 21*ga* and between the flat lower sub-surface 21*ge* and the flat lower sub-surface 21*gb*. The flat lower sub-surfaces 21*gd*/21*ge* and the round sub-surfaces 21*gf* and 21*gg* define a shallow recess 21*ha*, and the arch sub-surface 21*gc* defines a deep recess 21*hb*. The shallow recess 21*ha* and the deep recess 21*hb* form in combination the multiple recess 21*h*.

As described hereinbefore, a vibration changes the frequency depending upon the thickness of the sound bar at the antinode. In this instance, the first-order vibration has the antinode in the thinnest portion defined by the arc sub-surface, and the second-order vibration and the third-order vibration have respective antinodes in the central portion 21*a* on bode sides of the thinnest portion. Therefore, the frequency of the first-order vibration is regulable independently from the second-order and third-order vibrations, and the central portion 21*a* on both sides of the thinnest portion has strong influence on the second-order vibration rather than the third-order vibration. Thus, the first-order and second-order vibrations are independently regulable, and the frequency ratio is adjusted to 1:4:8 without a recess of the end portions 21*b*/21*c*.

The percussion instrument of the second embodiment achieves all of the advantages of the first embodiment.

Third Embodiment

Figure 7A:
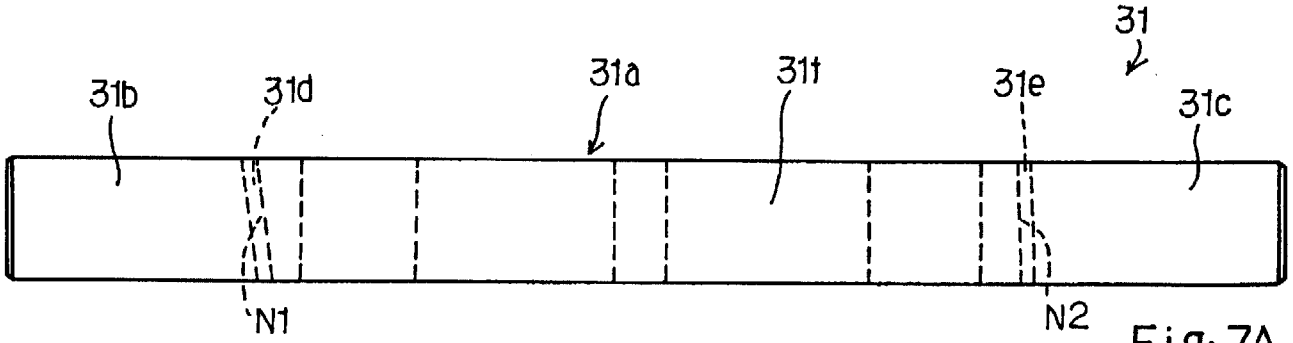
FIG. 7A is a plan view showing a sound bar incorporated in yet another percussion instrument according to the present invention.
Figure 7B:
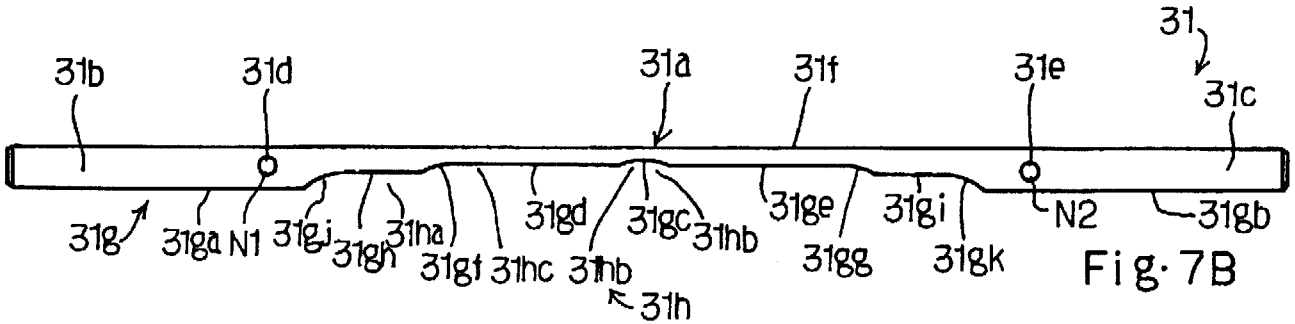
FIG. 7B is a front view showing the sound bar.
Figure 7C:
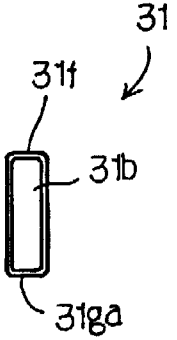
FIG. 7C is a side view showing the sound bar.

FIGS. 7A to 7C of the drawings illustrate a sound bar 31 incorporated in a percussion instrument embodying the present invention. The sound bar 31 is divided to a central portion 31*a* and end portions 31*b* and 31*c*, and holes 31*d* and 31*e* are formed in the boundary between the end portion 31*b* and the central portion 31*a* and between the central portion 31*a* and the end portion 31*c*. Though not shown in FIGS. 7A to 7C, braids pass through the holes 31*d* and 31*e*, and the sound bar 31 floats over a frame structure (not shown).

The sound bar 31 has a flat upper surface 31*f* beaten with a mallet (not shown), and a lower surface 31*g* is partially curved so as to form a multiple recess 31*h* in the central portion 31*a*. However, the end portions 31*b* and 31*c* have respective flat lower sub-surface 31*ga* and 31*gb* substantially in parallel to the upper surface 31*f*, and no recess is formed in the end portions 31*b* and 31*c*.

The lower surface 31*g* defines the multiple recess 31*h* as follows. The lower surface 31*g* is curved to form an arc sub-surface 31*gc* at the mid portion of the sound bar 31, and first flat lower sub-surfaces 31*gd* and 31*ge* are contiguous to the arc sub-surface 31*gc* in parallel to the upper surface 31*f*. First round sub-surfaces 31*gf* and 31*gg* extend between the first flat lower sub-surfaces 31*gd*/31*ge* and second flat power sub-surfaces 31*gh* and 31*gi*. Second round sub-surfaces 31*gj* and 31*gk* connect the second flat lower sub-surfaces 31*gh* and 31*gi* to the flat lower sub-surfaces 31*ga* and 31*gb*. The second flat lower sub-surfaces 31*gh*/31*gi* and the second round sub-surfaces 31*gj* and 31*gk* define a shallow recess 31*ha*, and the arch sub-surface 31*gc* defines a deep recess 31*hb*. The first flat lower sub-surfaces 31*gd*/31*ge* and the first round sub-surfaces 31*gf*/31*gg* define an intermediate recess 31*hc*, and the shallow recess 31*ha*, the intermediate recess 31*hc* and the deep recess 31*hb* form in combination the multiple recess 31*h*.

In this instance, the first-order vibration has the antinode in the thinnest portion defined by the deep recess 31*hb*, the second-order vibration has the antinodes in the thinner portion defined by the intermediate recess 31*hc*, and the third-order vibration has antinodes in the thin portion defined by the shallow recess 31*ha*. Therefore, the frequency of the first-order vibration, the frequency of the second-order vibration and the frequency of the third-order vibration are independently regulable by selecting the thicknesses of the thinnest, thinner and thin portions, and the frequency ratio is adjusted to 1:4:8 without a recess of the end portions 31*b*/31*c*.

The percussion instrument of the second embodiment achieves all of the advantages of the first embodiment.

Fourth Embodiment

Figure 8A:
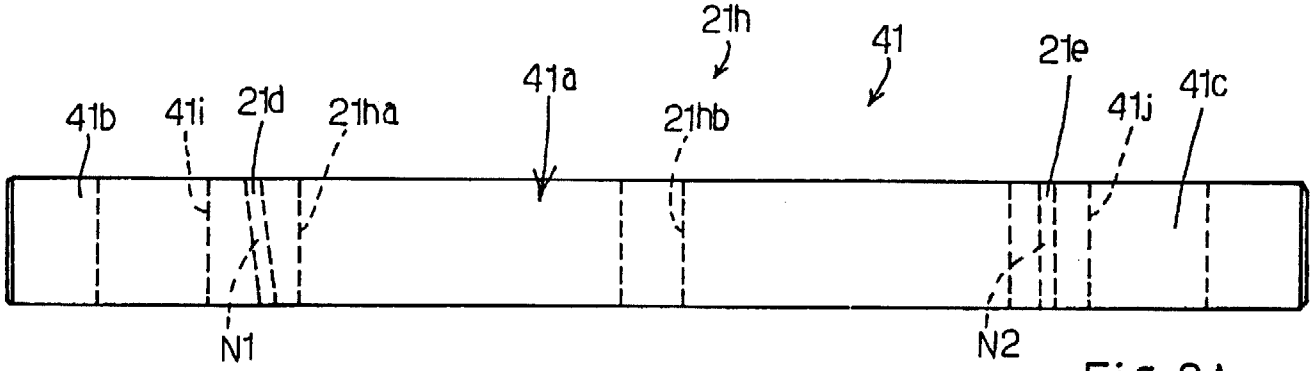
FIG. 8A is a plan view showing a sound bar incorporated in still another percussion instrument according to the present invention.
Figure 8B:
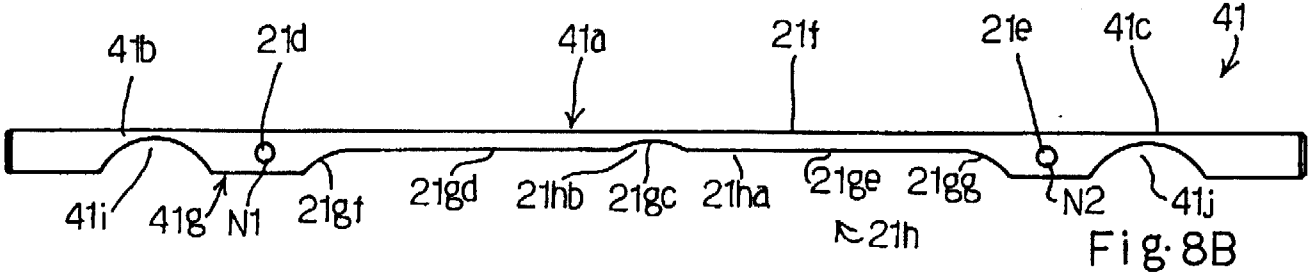
FIG. 8B is a front view showing the sound bar.
Figure 8C:
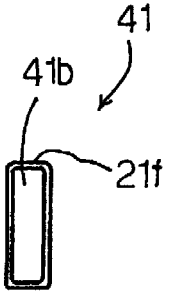
FIG. 8C a side view showing the sound bar.

FIGS. 8A to 8C illustrate a sound bar 41 incorporated in still another percussion instrument embodying the present invention. The sound bar is divided into a central portion 41*a* and end portions 41*b* and 41*c*. The central portion 41*a* is similar to the central portion of the second embodiment, and surfaces and recesses are labeled with the same references designating the corresponding surfaces and recesses of the second embodiment without detailed description.

The end portions 41*b* and 41*c* have respective recesses 41*i* and 41*j*. The recesses 41*i* and 41*j* have the same influence of the vibration characteristics on the sound bar 41 as the recesses 11*r* and 11*t*, and the frequency ratio is exactly regulated to 1:4:8.

Fifth Embodiment

Figure 9A:
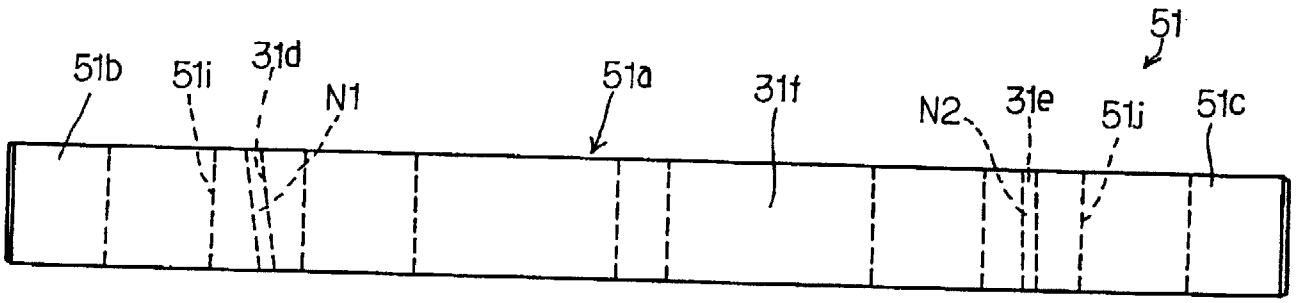
FIG. 9A is a plan view showing a sound bar incorporated in a percussion instrument according to the present invention.
Figure 9B:
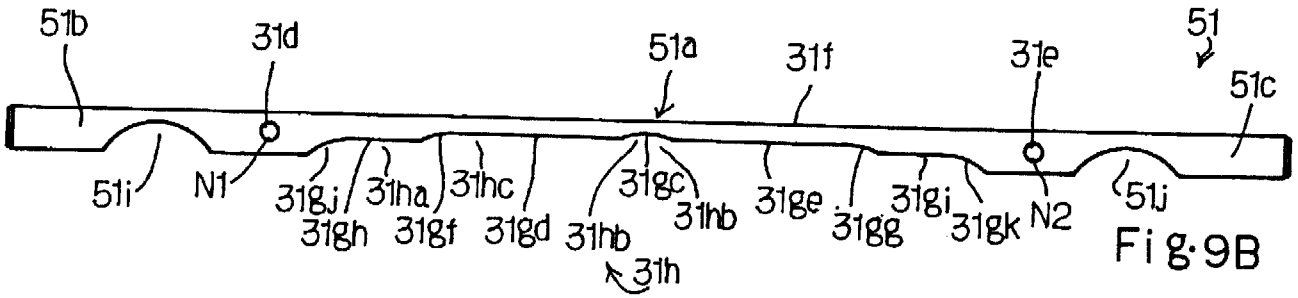
FIG. 9B is a front view showing the sound bar.
Figure 9C:
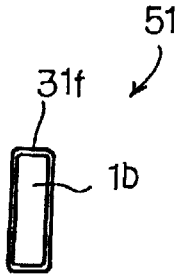
FIG. 9C is a side view showing the sound bar.

FIGS. 9A to 9C illustrate a sound bar 51 incorporated in a percussion instrument embodying the present invention. The sound bar 51 is divided into a central portion 51*a* and end portions 51*b* and 51*c*. The central portion 51*a* is similar to the central portion of the third embodiment, and surfaces and recesses are labeled with the same references designating the corresponding surfaces and recesses of the third embodiment without detailed description.

The end portions 51*b* and 51*c* have respective recesses 51*i* and 51*j*. The recesses 51*i* and 51*j* have the same influence of the vibration characteristics on the sound bar 51 as the recesses 11*r* and 11*t*, and the frequency ratio is exactly regulated to 1:4:8.

Sixth Embodiment

Figure 10A:
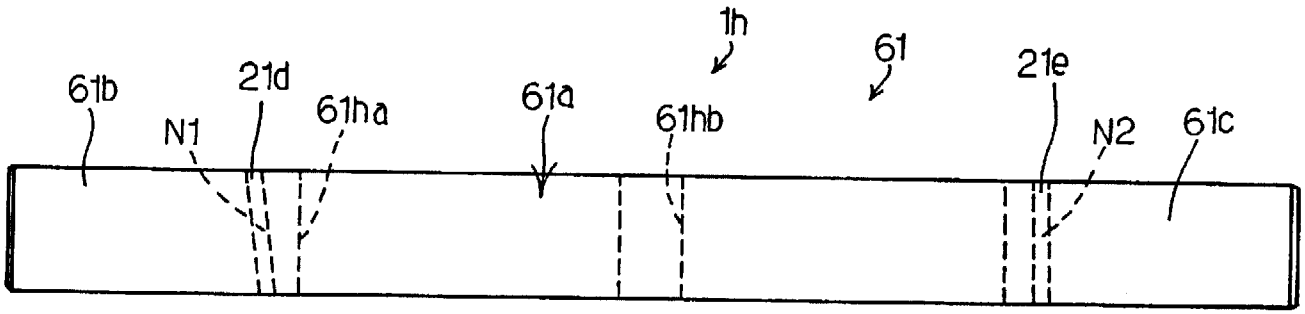
FIG. 10A is a plan view showing a sound bar incorporated in a percussion instrument according to the present invention.
Figure 10B:
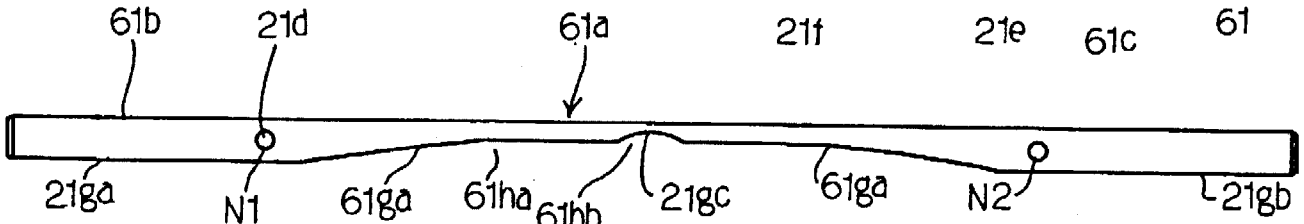
FIG. 10B is a front view showing the sound bar.
Figure 10C:
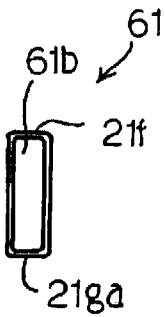
FIG. 10C is a side view showing the sound bar.

FIGS. 10A to 10C illustrates a sound bar 61 incorporated in a percussion instrument embodying the present invention. The sound bar 61 is divided into a central portion 61*a* and end portions 61*b* and 61*c*. The end portions 61*b* and 61*c* are similar to those of the second embodiment, and surfaces of the end portions are labeled with the same references designating the corresponding surfaces of the end portions 11*j* and 11*k* without detailed description.

A multiple recesses 61*h* is formed in the central portion 61*a*, and a shallow recess 61*ha* and a deep recess 61*hb* form in combination the multiple recesses 61*h*. The deep recess 61*hb* is defined by the arc sub-surface 21*gc*, and the shallow recess 61*ha* is defined by another arc sub-surface 61*ga*. The radius of curvature of the arc sub-surface 61*ga* is larger than that of the arc sub-surface 21*gc*, and no flat surface is incorporated in the lower surface defining the central portion 61*a*.

The sixth embodiment achieves all of the advantages of the second embodiment.

Seventh Embodiment

Figure 11A:
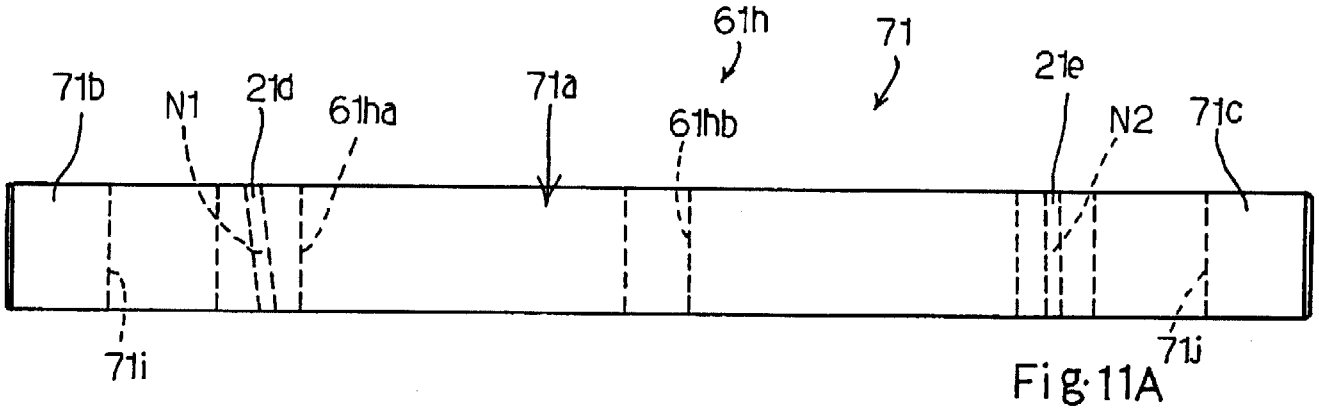
FIG. 11A is a plan view showing a sound bar incorporated in a percussion instrument according to the present invention.
Figure 11B:
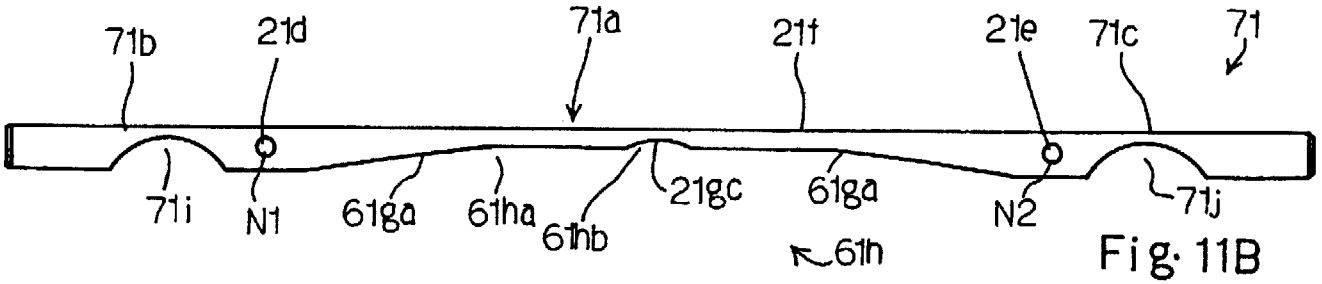
FIG. 11B is a front view showing the sound bar.
Figure 11C:
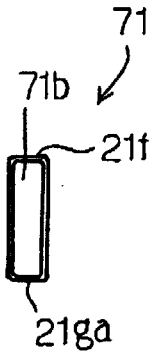
FIG. 11C is a side view showing the sound bar.

FIGS. 11A to 11C illustrate a sound bar 71 incorporated in a percussion instrument embodying the present invention. The sound bar 71 is divided into a central portion 71*a* and end portions 71*b* and 71*c*, and the central portion 71*a* is similar to the central portion 61*a* of the sixth embodiment. Surfaces and recesses of the central portion 71*a* are labeled with the same references as those of the sixth embodiment without detailed description.

Recesses 71*i* and 71*j* are formed in the end portions 71*b* and 71*c*. Therefore, the frequency ratio is exactly regulated to 1:4:8.

As will be appreciated from the foregoing description, the recess or the multiple recess of the central portion regulates the frequencies of the first-order to third-order vibrations, and the recesses of the end portions differently changes the frequencies of the first-order to third-order vibrations. As a result, the frequency ratio of the first-order to third-order vibrations is regulated to 1:4:8. The sound bars thus regulated generates the tones exactly on the scale, and the tones of a chord beautifully harmonize with one another.

Although particular embodiments of the present invention have been shown and described, it will be obvious to those skilled in the art that various changes and modifications may be made without departing from the spirit and scope of the present invention.

For example, the sound bar according to the present invention is available for a percussion instrument of a definite pitch such as, for example, a xylophone, a glockenspiel and a marimba.

Moreover, the sound bar may be formed of wood or synthetic resin.

What is claimed is:

1. A percussion instrument comprising:

a plurality of sound bars respectively assigned notes of a scale, and generating vibrations when a player beats, the vibrations of each of said plurality of sound bars having at least a first-order vibration for mainly impressing the note assigned to said each of said plurality of sound bars, a second-order vibration and a third-order vibration, a frequency ratio of said first-order vibration, said second-order vibration and said third-order vibration being equal to 1:4:8; and a frame structure supporting said plurality of sound bars, and allowing said plurality of sound bars to freely vibrate.

2. The percussion instrument as set forth in claim 1, in which said each of said plurality of sound bars is divided into a central portion and end portions with respect to nodal points where nodes of said first-order vibration take place, said central portion having a first recess at a central sub-portion where an antinode of said first-order vibration takes place, each of said end portions having a second recess.

3. The percussion instrument as set forth in claim 2, in which said first recess and the second recesses are open to a lower surface reverse to an upper surface where a player beats.

4. The percussion instrument as set forth in claim 1, in which said each of said plurality of sound bars is divided into a central portion and end portions with respect to nodal points where nodes of said first-order vibration take place, said central portion having a multiple recess implemented by a plurality of first recesses nested in one another, the deepest recess of said plurality of first recesses being defined by an arc surface in such a manner as to locate said deepest recess at a certain sub-portion where an antinode of said first-order vibration takes place.

5. The percussion instrument as set forth in claim 4, in which said plurality of first recesses further has a shallow recess defined by a flat surface contiguous to said arc surface and a round surface extending between said flat surface and surfaces of said end portions.

6. The percussion instrument as set forth in claim 5, in which said deep recess and said shallow recess are open to a lower surface reverse to an upper surface where a player beats.

7. The percussion instrument as set forth in claim 5, in which each of said end portions has a second recess.

8. The percussion instrument as set forth in claim 7, in which said deep recess, said shallow recess and the second recesses are open to a lower surface reverse to an upper surface where a player beats.

9. The percussion instrument as set forth in claim 5, in which said plurality of first recesses further has an intermediate recess formed between said deep recess and said shallow recess.

10. The percussion instrument as set forth in claim 9, in which said deep recess, said shallow recess and said intermediate recess are open to a lower surface reverse to an upper surface where a player beats.

11. The percussion instrument as set forth in claim 9, in which each of said end portions has a second recess.

12. The percussion instrument as set forth in claim 11, in which said deep recess, said shallow recess, said intermediate recess and the second recesses are open to a lower surface reverse to an upper surface where a player beats.

13. The percussion instrument as set forth in claim 4, in which said plurality of first recesses further has a shallow recess defined by another arc surface contiguous to said arc surface.

14. The percussion instrument as set forth in claim 13, in which said deep recess and said shallow recess are open to a lower surface reverse to an upper surface where a player beats.

15. The percussion instrument as set forth in claim 13, in which each of said end portions has a second recess.

16. The percussion instrument as set forth in claim 15, in which said deep recess, said shallow recess and the second recesses are open to a lower surface reverse to an upper surface where a player beats.

17. The percussion instrument as set forth in claim 1, further comprising a plurality of resonators provided beneath said plurality of sound bars.

* * * * *